United States Patent [19]

McIntyre

[11] Patent Number: 4,520,243

[45] Date of Patent: May 28, 1985

[54] ELECTRICAL PLUG AND SOCKET CONNECTION DEVICE

[76] Inventor: Raymond E. McIntyre, 31 Southern Cross Dr., Cronin Island, Surfers Paradise, Queensland, Australia

[21] Appl. No.: 416,762

[22] Filed: Sep. 10, 1982

[30] Foreign Application Priority Data

Sep. 24, 1981 [AU] Australia ..... PF0906

[51] Int. Cl.[3] ..... H01R 19/68

[52] U.S. Cl. ..... 200/51.07; 200/51.09; 339/41

[58] Field of Search ..... 200/51.07, 51.08, 51.09, 200/51.03; 339/40–42

[56] References Cited

U.S. PATENT DOCUMENTS

| | | | |
|---|---|---|---|
| 2,127,473 | 8/1938 | Sacco | 200/51.07 |
| 2,288,376 | 6/1942 | Tuppen | 200/51.07 |
| 2,374,032 | 4/1945 | Mueller | 200/51.09 |
| 2,857,570 | 10/1958 | Simpson | 200/51.07 |
| 3,329,784 | 7/1967 | Rogero | 200/68.2 |
| 4,148,536 | 4/1979 | Petropoulsos et al. | 200/51.09 |
| 4,185,881 | 1/1980 | Foley et al. | 200/51.07 |

*Primary Examiner*—Stephen Marcus
*Assistant Examiner*—Renee S. Kidorf
*Attorney, Agent, or Firm*—Sughrue, Mion, Zinn, Macpeak, and Seas

[57] ABSTRACT

This invention relates to an electrical connection device including a male component or plug having a plurality of connection pins extending outwardly therefrom. The electrical connection device also includes a female component or socket body having—

(i) a plurality of recesses contained therein;
(ii) a plurality of contact members wherein each contact member is associated with a respective recess;
(iii) a plurality of connection terminals; and
(iv) switching means.

The arrangement is such that each connection pin of the male component may be inserted in a mating recess of the female component and thereby engage with an associated contact member wherein after a rotational or pivoting movement of one component relative to the other this may cause movement of the switching means to effect electrical connection between each contact member and an associated connection terminal.

6 Claims, 10 Drawing Figures

FIG. 3
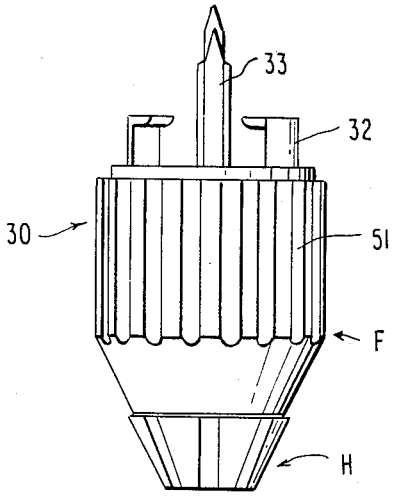
FIG. 4
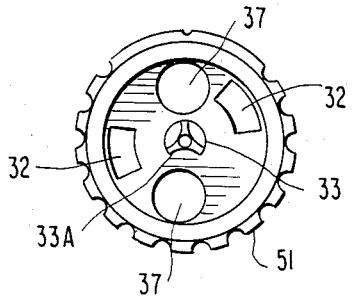
FIG. 5
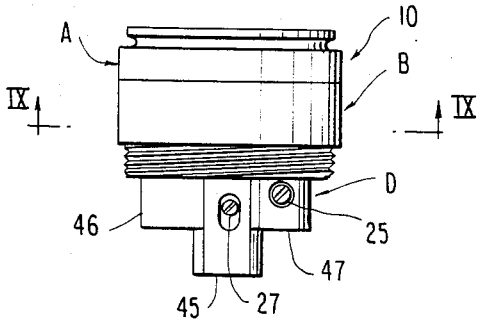
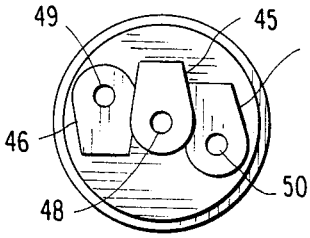
FIG. 6
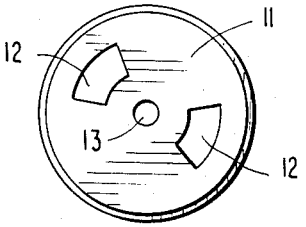
FIG. 7

FIG. 8
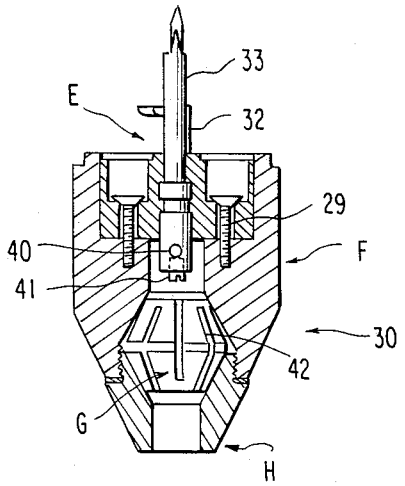
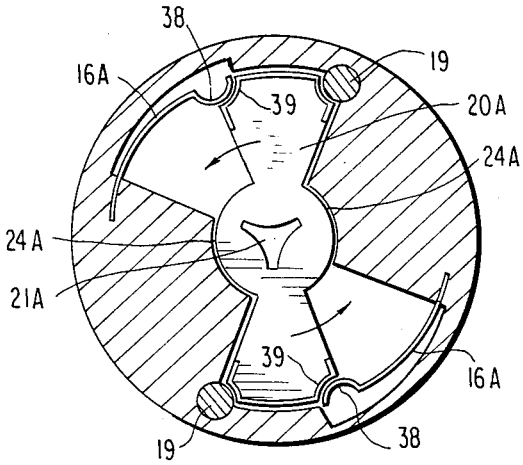
FIG. 9
FIG. 10
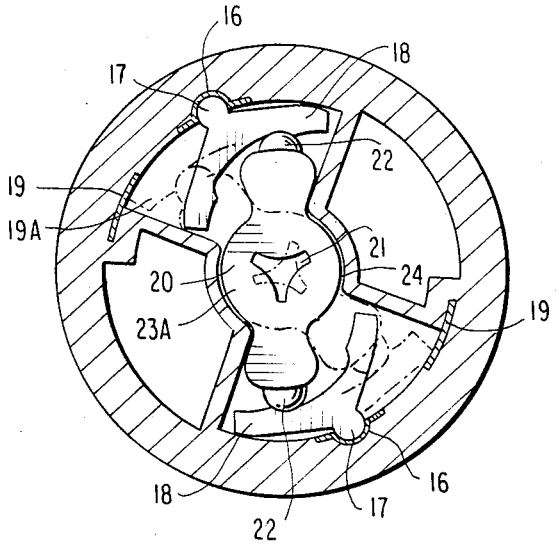

ELECTRICAL PLUG AND SOCKET CONNECTION DEVICE

This invention relates to improvements concerning electrical connection devices which when connected supply electrical current to electrical appliances and which include within their scope electrical switches including switch bodies and switch plates, extension cords, connection plugs, connection socket bodies and the like.

The invention is primarily concerned with the outwardly extending connection pins or terminals attached to one device and to the corresponding recesses which contain or are associated with contacting terminals for said outwardly extending pins or terminals.

Australian specification No. 13981/76 in the name of D. J. Rohrssen discloses an electrical connection device including a male body having the aformentioned outwardly extending connection pins and a female body having the aforementioned recesses. The male body and plug has an outer planar face from which the connection pins extend and the female body or socket body also has a planar face containing the above mentioned recesses and wherein the respective faces of both plug and socket body may abut when attached together.

The connection pins in the above mentioned Rohrssen specification are provided with laterally offset portions which are located at the respective free ends of the shank of each pin. The recesses for each of these pins includes an arcuate portion and a laterally offset portion and are complementary in shape to their associated conducting pins of the plug. The plug also has a central earthing pin which engages in a mating cylindrical recess or passage in the socket body. The arrangement is such that as the pins of the plug are inserted in their mating recesses it requires a pivotal or rotational motion of the plug relative to the socket body to bring about complete engagement and thereby electrically connect the connection pins of the plugs to their associated contact terminals located in the respective recesses of the socket body. In this procedure the central earthing pin of the plug may serve as a pivot pin about which the connection pins may be pivoted or rotated.

Although specification No. 13981/76 describes a raised detent in each contact terminal so as retain the connection pins of the plugs in firm engagement with their respective contact terminal after the end of the pivotal movement of the plug relative to the socket body, it has now been found that this feature is not satisfactory in inhibiting or preventing children from tampering with a socket body and being accidently electrocuted. This is because the contact terminals in the socket body are still accessible from the planar face of the socket body and thus a child may insert a conductor into a recess of the socket body and contact the contact terminal contained therein.

It is therefore an object of the invention to provide an electrical connection device including:

a male component having a plurality of connection pins extending outwardly therefrom;

a female component having (i) a plurality of recesses contained therein;

(ii) a plurality of contact members wherein each contact member is associated with a respective recess;

(iii) a plurality of connection terminals; and (iv) switching means;

the construction and arrangement being such that each connection pin may be inserted in a mating recess and may engage with an associated contact member whereby after a rotational or pivoting movement of one component relative to the other this may cause movement of said switching means to effect electrical connection between each contact member and an associated connection terminal.

The male component is suitably connectable to an electrical appliance such as a toaster, refrigerator, electrical light fitting, electric shaver and the like and is suitably a connection plug having a planar face from which said plurality of connection pins extend preferably at right angles thereto.

The female component is suitably attachable to a source of electrical supply through said connection terminals which are suitably located in a base portion thereof. Preferably the female component includes a front planar face which accommodates said plurality of recesses. The female component may include a switch body or switch plate or a socket body which engages with the connection plug referred to above. The socket body may be part of an extension cord or other electrical connection component.

The connection pins of the male component are suitably conducting pins of any suitable shape and which are preferably arcuate or curved. There may be located at each free or outer end of each conducting pin a laterally extending portion which is offset relative to the longitudinal axis of the conducting pin. The recesses of the female component are appropriately similar in shape to their respective mating conducting pins and may be provided at their respective inner ends with a laterally extending or offset inner end portion which is complementary or similar in shape to the offset outer end portion of each conducting pin.

There also may be provided a centrally located guide pin or earthing pin of the male component which is preferably longer than the pair of conducting pins (i.e. neutral and active). The guide pin may act as a fulcrum or pivot point when the male component is rotated relative to the female component before the above described offset outer end portions of the conducting pins engage in their respective laterally extending or offset inner end portions of their mating recesses.

There also is provided contact members which are suitably located in or associated with the offset inner end portions of the recesses in the female component and which extend downwardly from said recesses towards the base portion of the female component.

The switching means in one form may include a switching arm rotatably attached to the female component and having a centrally located aperture which is engaged by the above described central guide pin when the male component is rotated relative to the female component. This in turn causes rotation or pivotal movement of the switching arm so as to effect electrical connection between each contact member and an associated connection terminal.

Preferably each of the contact members at their lower or downwardly extending ends have attached thereto a rocker arm pivotally attached to the contact member which engages with an adjacent portion of the switching arm whereby upon movement of the switching arm in one direction each rocker arm may pivot from a position of disengagement with an associated connection terminal to an engagement position. Movement of the switching arm in the other or opposite direction may cause movment of each rocker arm back to the disengaged position. Suitably each rocker arm is biassed by suitable biasing means towards the disengaged position.

In another embodiment each end of the switching arm may act as a bridge between each contact member and an adjacent connection terminal when the switching arm is rotated in one direction and when rotated in the opposite direction each end of the switching arm may firmly engage with the contact memnber in a snap fit or clipped relationship so as to constrain or firmly retain the switching arm in the disengaged position or non bridging position.

Reference may now be made to a preferred embodiment of the invention as shown in the attached drawings wherein:

FIG. 3 is a side view of the assembled male component shown in FIG. 2;

FIG. 4 is a top plan view of the male component shown in FIG. 3;

FIG. 5 is a side view of the female component of FIG. 1;

FIG. 6 is a bottom plan view of the female component of FIG. 5;

FIG. 7 is a top plan view of the female component of FIG. 5;

FIG. 8 is a half sectional view of the male component shown in FIG. 3;

FIG. 9 is a cross sectional view along line IX—IX of FIG. 5 illustrating one form of switching means utilized in the electrical connection device of the invention;

FIG. 10 is a view similar to FIG. 9 but illustrating another form of switching mechanism utilized in the electrical connection device of the invention.

Figure 1:
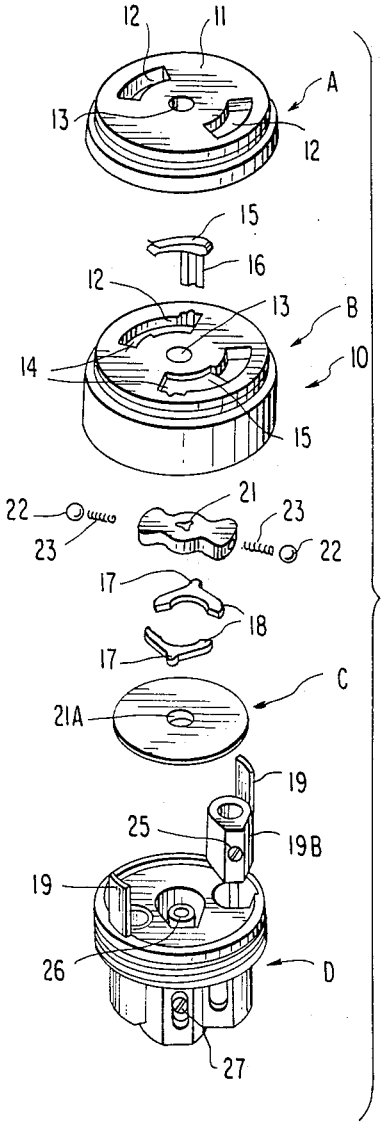
FIG. 1 is an exploded view of a female component constructed in accordance with the invention.

In the drawings there is shown female component 10 having a planar front face 11, curved recesses 12 and cylindrical recess or passage 13. Recesses 12 have laterally offset end portions 14 which are located adjacent contact members 15 having a shank or stem 16 to which is attached pivot pin or part 17 for rocker arm 18. There are also shown supply terminals 19 and switching arm 20 rotationally supported in a cavity 19A within female component 10. Each end of switching arm 20 is supported by spring loaded balls 22 biased by springs 23 which urge the arm 20 towards the position shown in FIG. 10 or the position in dotted outline. Switching arm 20 has central aperture or socket 21 and has a bulbous or spherical middle part 23A which is retained in position by bearing surfaces 24 of female component 10. Upon movement of switching arm 20 in an anti-clockwise direction rocker arms 18 may pivot about their respective pivot pins 17 and one end of rocker arm 20 may engage with an adjacent terminal 19 as shown in the dotted outline. Movement of rocker arms 18 is caused by movement of balls 22 which are moved upon rotational movement of switching arm 20.

Supply terminals 19 may form part of a terminal body 19B which can engage with conducting cables (not shown) by the use of clamping screws 25. There is also shown an earthing terminal 26 which may engage with an earth wire (not shown) by clamping screw 27.

The female component may be formed by top part A, intermediate body part B, plate C and terminal part D as shown in FIG. 1. Place C has central aperture 21A for the guide pin of the male component.

Plug or male component 30 includes a pair of conducting pins 32 having laterally offset end portions 32A. There is also shown centrally located guide pin or earthing pin 33 having a cross sectional shape complementary to socket 21 of switching arm 20.

Plug 30 has planar face 34 which abuts with mating face 11 of female component 10 when engaged with female component 10. Guide pin 33 has terminal 33A for engaging with terminal 26 previously described.

Figure 2:
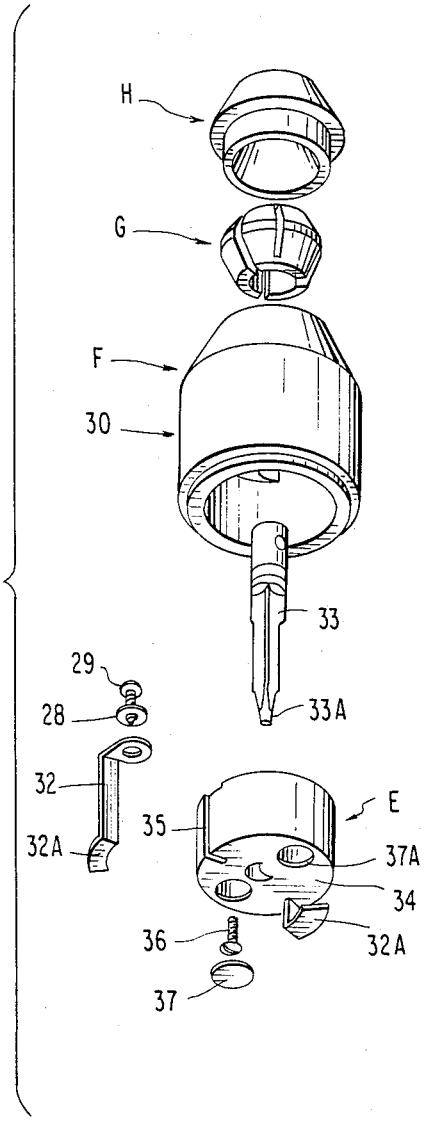
FIG. 2 is an exploded view of a male component constructed in accordance with the invention.

There is also shown screws 29 and associated washers 28 for attachment of pins 32 to male component 30 as shown in FIG. 2. Pins 32 locate in recesses 35 of component 30.

Component 30 also comprises body portion E, housing component F, cord retaining means G and guide component H. Attachment screws 36 having covers 37 attach component E to component F through sockets 37A.

In FIG. 9 there is shown a modified switching arm 20A having central aperture or socket 21A and having a ball shaped central portion supported by bearing surfaces 24A of female component 10. Switching arm 20A is shown in the operative position forming a bridge between supply terminals 19 and contact members 16A. In the operative position resilient ends 38 of contact members 16A engage with mating electrically conductive surfaces 39 extending over each end of the non-conductive switching arm 20A. Switching arm 20A also has contact surfaces 39 engaging supply terminals 19 as shown.

In the inoperative position which is attained by rotation of switching arm 20A in the direction of the arrows each end of switching arm 20A bear against an associated contact member 16A. By the provision of resilient ends 38 each end of switching arm 20A is retained firmly in the inoperative position unless rotated clockwise by guide pin 33 engaging in central aperture or socket 21A.

Guide pin 33 of male component 30 also has aperture 40 for retention of an earthing wire (not shown) which retained therein by screws 41. Cord retaining device G has elongate slots 42 which have a self-tightening action about an electrical cord (not shown) when the various parts of male component 30 are assembled together. Cord retaining device G is resiliently deformable.

Conducting pins 32 of plug or male component 30 engage in curved recesses 12 of female component 10 so that laterally offset ends 32A may engage in offset inner ends 14 of recesses 12, and thereby engage with contact members 15 or 16A. In this situation guide pin 33 engages in central aperture 21 or 21A of switching arm 20 or 20A and causes rotation of switching arm 20 or 20A to cause electrical connection between pins 32 and supply terminals 19 as described above. This provides positive protection against electrocution if a conductor is inadvertantly inserted in recesses 12 because of the fact that although contact member 15 or 16A may be contacted there is still no electrical connection between contact member 16A and supply terminal 19. This requires rotation of switching arm 20 or 20A.

For the foregoing it will also be appreciated that recesses 12 are located on the circumference of a common circle as shown in FIG. 7 relative to face 11 as is the case with conducting pins 32 relative to face 34. Laterally offset portions 32A of pins 32 also follow the circumference of the same common circle as shown in FIG. 4. The same applies to laterally offset inner ends 14 of the recesses 12.

Female component or socket 10 includes attachment projection 45 for the earth wire, 46 for the neutral wire and 47 for the active wire. Each projection has associated passages 48, 49 and 50 for retention of their respective wires which are secured by screws 25 and 27.

Male component 30 may be milled or provided with corrugations 51 as shown in FIGS. 3–4 which may act as a suitable finger grip.

In operation of the electrical connection device of the invention, the terminal end 33A of pin 33 may be inserted into recess 13 and pins 32 aligned with mating recess 12 so that faces 11 and 34 engage.

In this position before a rotation of component 30 there is no electrical connection between pins 32 and supply terminals 19. As pin 33 is relatively long in comparison to pins 32, when pin 33 is inserted into the recesses an earthing connection is obtained between terminal 26 and terminal end 33A and earthing wire in aperture 40. Electrical connection between pins 32 and terminals 19 can only be achieved by rotating component 30 45° relative to component 10. This rotation ensures that switching arm 20 rotates and that rocker arms 18 move from their full line position of FIG. 10 (where no electrical connection is provided) to their dotted line position in FIG. 10 to provide a connection between terminals 19 and pins 32. This connection is from terminal 19, through arms 18 to stem 16 associated with contact member 15 to pins 32, which when component 30 is rotated, move from a position in curved recess 12 remote from end portions 14 into the end portion 14 and into contact with the contact members 15. Thus, contacts 19 are not visible from the outside of component 10 and cannot be contacted by anything other than the arms 18. Should component 10 be tampered with by a pin or the like other than guide pin 33, only the earth terminal can be contacted and the device remains safe. Disconnection may be achieved by an anticlockwise turn of male component 30 relative to female component 10.

It will also be appreciated that the invention includes within its scope the male component per se and the female component per se.

I claim:

1. An electrical plug and socket connection device comprising a male component having a plurality of connection pins and a centrally located guide pin extending outwardly therefrom with the guide pin having a longer length than each connection pin and a female component having a plurality of connection pin recesses, a central aperture, an internal cavity, a plurality of contact members with each contact member located adjacent to and extending into an associated connection pin recess with a portion extending into said cavity and a plurality of connection terminals extending into said cavity, a switching means rotatably mounted in said cavity and having a socket in alignment with said central aperture which is engageable by said guide pin when said connection pins of said male component are engaged in said recesses of said female component whereby upon rotation of one component relative to the other each connection pin abuts an adjacent contact member and said switching means is pivoted by the engagement of said guide pin in said socket to simultaneously contact and thereby effect electrical connection between each contact member and a respective connection terminal.

2. An electrical plug and socket connection device as claimed in claim 1 wherein each connection pin has a laterally extending portion which is offset relative to the longitudinal axis thereof and wherein at least part of each associated mating recess is complementary in shape.

3. An electrical plug and socket connection device as claimed in claim 1 wherein said switching means includes a two arm lever rotatably mounted in said cavity with said two arm lever having a centrally located socket extending therethrough and further comprising a ground means centrally disposed in said female component for engagement by said guide pin when said guide pin is inserted through said socket in said two arm lever.

4. An electrical plug and socket connection device as claimed in claim 3 wherein each contact member is stationary and includes a resilient portion for engaging with said two arm lever in an inoperative or operative position whereby each end of said two arm lever acts as a bridge between each contact member and an associated connection terminal with said resilient portion biasing the movement of said two arm lever to the inoperative or operative position.

5. An electrical plug and socket connection device as claimed in claim 3, said switching means further comprises a rocker arm pivotally mounted on the portion of each contact member extending into said cavity whereby pivotal movement of said two arm lever causes rocking movement of each rocker arm from an inoperative position to an operative position engaging an adjacent connection terminal.

6. An electrical plug and socket connection device as claimed in claim 5 wherein a spring loaded ball device is provided between each rocker arm and said two arm lever to bias each rocker arm to an inoperative or operative position.

* * * * *